United States Patent [19]

Keep

[11] 4,347,269

[45] Aug. 31, 1982

[54] METHOD OF AND APPARATUS FOR APPLYING A COATING TO A WEB OF SHEET MATERIAL

[75] Inventor: Geoffrey S. Keep, Henley-on-Thames, England

[73] Assignee: The Wiggins Teape Group Limited, Hampshire, England

[21] Appl. No.: 250,294

[22] Filed: Apr. 2, 1981

[30] Foreign Application Priority Data

Apr. 8, 1980 [GB] United Kingdom ..... 8011462

[51] Int. Cl.[3] ..... B05D 1/28

[52] U.S. Cl. ..... 427/428; 118/249; 118/262

[58] Field of Search ..... 118/262, 249; 427/428

[56] References Cited

U.S. PATENT DOCUMENTS

| | | | |
|---|---|---|---|
| 2,293,691 | 8/1942 | Harrigan | 427/1 |
| 2,631,643 | 3/1953 | Schueler | 154/20 |
| 2,681,636 | 6/1954 | Fridolph | 118/249 |
| 3,466,184 | 9/1969 | Bowler et al. | 117/36.2 |
| 3,468,700 | 9/1969 | Long | 117/111 |
| 3,630,835 | 12/1971 | Busch | 162/184 |
| 3,647,525 | 3/1972 | Dahlgren | 117/111 |
| 3,663,359 | 5/1972 | Braim | 162/106 |
| 3,672,952 | 6/1972 | Brown | 161/146 |
| 3,820,505 | 6/1974 | Goldbach et al. . | |
| 3,951,102 | 4/1976 | Allen | 118/118 |
| 4,061,109 | 12/1977 | Allen | 118/249 |
| 4,198,446 | 4/1980 | Goetz | 427/150 |

FOREIGN PATENT DOCUMENTS

| | | |
|---|---|---|
| 203268 | 9/1956 | Australia . |
| 1577786 | 3/1969 | Fed. Rep. of Germany . |
| 7708599 | 6/1979 | Netherlands . |
| 977063 | 12/1964 | United Kingdom . |
| 1201233 | 8/1970 | United Kingdom . |
| 1280265 | 7/1972 | United Kingdom . |
| 1361996 | 7/1974 | United Kingdom . |
| 1472709 | 5/1977 | United Kingdom . |

OTHER PUBLICATIONS

Translation of Japanese Utility Model Publication 108/36, 1/7/36.

TAPPI, Solventless Silicone Coatings Short Course, 1978, pp. 33–35, 37–45, 47–49, 50–53, 81–86.

Factors Affecting Solventless Silicone Release Coatings, Grenoble, Paper, Film & Foil Converter, Jun. 1978.

Silicone Coating, Swain, Paper Technology and Industry, Jan. 1978, pp. 26–29.

Translation of Japanese Utility Model Publication, No. 17127/35, 11/12/35.

*Primary Examiner*—Shrive P. Beck

*Attorney, Agent, or Firm*—Burns, Doane, Swecker & Mathis

[57] ABSTRACT

In an offset gravure web coating method and apparatus, coating composition is applied from a gravure roll to a transfer roll, thence to an applicator roll, and finally to the web. The web moves in the same direction as the applicator roll surface. The ratio of the speed of the applicator roll surface to that of the web is preferably not greater than 1:1. The method and apparatus afford improved coating patterns at low wet coatweights.

3 Claims, 6 Drawing Figures

METHOD OF AND APPARATUS FOR APPLYING A COATING TO A WEB OF SHEET MATERIAL

This invention relates to a method of, and apparatus for, applying a coating to a web of sheet material. The invention is particularly applicable to the coating of continuous paper webs.

When it is desired to apply a low weight coating (i.e. a coating of less than 10 $gm^{-2}$) to a moving web of material, a gravure coating method is often used. Using this method, the coating composition is metered by a gravure roll on the surface of which are provided cells or depressions. The gravure roll may either apply the coating directly to the web in which case the method is described as direct gravure, or the gravure roll may transfer the coating to an applicator roll which applies the coating to the web in which case the method is described as offset gravure. In either case, a backing roll is usually employed to support the rear surface of the web at the point of contact with the roll which applies the coating. In an offset coater, the applicator roll is normally rotated by contact with the gravure roll. Since direct gravure coating suffers from the disadvantage that it is difficult to control the weight of coating applied, the offset method is usually to be preferred.

With one known type of offset gravure coating apparatus, the coating material is picked up from a bath by a gravure roll, transferred from the gravure roll to an applicator roll driven by the gravure roll and from the applicator roll to the web to be coated which moves against the direction of rotation of the applicator roll. Since the applicator roll is driven by the gravure roll, its speed of rotation is dependent on that of the gravure roll.

The speed of rotation of the gravure roll is limited in that too high a speed results in incomplete filling of the gravure cells as they pass through the bath of coating composition. This would result in variable coatweight. The web speed is normally predetermined, and in order to achieve complete and even transfer of coating material from the applicator roll to the web i.e. a good coating pattern, the relative speeds of the web and the applicator roll must be within a fairly narrow range. Thus the speed of rotation of the applicator roll must be chosen to take account of both the web speed and the maximum speed at which the gravure roll can effectively pick up coating composition. These two parameters are independent and in some cases incompatible, with the result that an even coating pattern is achievable only at certain coatweights, and that the applicator roll speed cannot be altered to improve coating pattern without also changing the coatweight applied (given a fixed web speed).

To overcome this problem, it has been proposed, in British Patent Specification No. 1,404,616, to make use of an offset gravure roll coating apparatus in which the gravure roll and the applicator roll are separated by a transfer roll driven independently of and in the same sense as the applicator roll. In such an apparatus, the applicator roll speed can be chosen to give a good coating pattern, and coatweight control can be achieved without affecting coating pattern by varying the gravure and transfer roll speeds.

This apparatus represents a considerable advance in that it enables evenly distributed coatings to be obtained at coatweights well below 10 $gm^{-2}$, for example down to 0.5 $gm^{-2}$, or less. However, it is found that with this apparatus an even coating is not obtained for all types of coating compositions or all types of web being coated, particularly at low coatweights.

Whilst it is not precisely known why this should occur, it is thought that it may be a function of the surface roughness of the web.

It is also found that there is a tendency for the applicator roll drive to become overloaded at very low coatweights. This is thought to be due to friction between the roll and the web. Another problem that is encountered is that the use of sufficient backing roll pressure to maintain web contact with the applicator roll occasionally leads to fluctuations in applicator roll speed.

It has now surprisingly been found that the above described problems can be eliminated or at least reduced by reversing the direction of the applicator roll relative to the web in such an apparatus, the applicator roll and the transfer roll being arranged for rotation in the same sense, and the gravure roll being arranged for rotation in the opposite sense.

Accordingly, the present invention provides, in a first aspect, a method of applying a coating composition to a continuous web of sheet material, comprising the steps of applying a metered amount of coating composition by means of a gravure roll to a transfer roll, transferring the coating composition from the transfer roll to an applicator roll which rotates in the same sense as the transfer roll and is driven independently thereof, and transferring the composition from the applicator roll to a moving web of sheet material to be coated, characterised in that the direction of movement of the web at its point of contact with the applicator roll is the same as the direction of movement of the applicator roll surface at that point.

In a second aspect the present invention provides an apparatus for applying a coating composition to a continuous web of sheet material comprising a gravure roll arranged to apply a metered amount of coating to a transfer roll, an applicator roll which is arranged to receive coating composition from the transfer roll, and is mounted for rotation independently of, and in the same sense as, the transfer roll, and means for feeding the web past the applicator roll characterised in that said means for feeding the web are adapted such that in use the web moves in the same direction as the applicator roll surface which it contacts.

The method and apparatus of this invention are particularly suitable for coating so-called solventless silicone compositions onto release bases for example clay coated film casting paper, and glassine calendered and clay coated release bases. As such compositions are very expensive, it is necessary for as thin as possible a coating to be applied (a coating of about 1 micron thickness corresponds to a coatweight of about 1 $gm^{-2}$). It is also desirable for a uniform coating pattern to be obtained as otherwise uneven release characteristics over the area of the web may result. The present method and apparatus are also suitable for applying other types of coating composition, for example microcapsule-containing and colour developer compositions as used in the manufacture of carbonless copying paper (such colour developer compositions may for example be based on colour developing clays or on phenolic resin/-kaolin mixtures).

Using the method and apparatus of this invention, the power consumed by the applicator roll drive is substantially reduced compared with the arrangement disclosed in British Pat. No. 1,404,614. For example, in the coating of glassine calendered release base with a solventless silicone, at a web speed of 100 m.min-1, and a web deckle of 508 mm on a pilot plant coater, the power consumed by the applicator roll drive of an embodiment of apparatus according to the invention was about 34 watts. The power developed by the same apparatus when modified to so as to run as disclosed in British patent specification No. 1,404,616 but otherwise operating under identical conditions was in excess of 1490 watts, the paper being coated being the same in each case.

Preferably, the apparatus further comprises a backing roll which forms a nip with the applicator roll through which the web to be coated is passed, and which is arranged to rotate in an opposite sense to the applicator roll.

Alternatively the apparatus may comprise guide rolls positioned so as to serve as a guide for the web of material as it passes in contact with the applicator roll during coating.

The transfer roll and/or the backing roll may be rubber-covered.

Preferably, the ratio of the speed of the applicator roll surface to that of the web at their point of contact is not greater than 1:1. Above that ratio there may be a tendency for streaking and other uneven coating pattern effects to occur.

Also, since the applicator roll speed is relatively low, the amount of splashing from the roll is reduced.

In order to enable the invention to be more readily understood, and to permit the benefits accruing from its use to be more readily appreciated, reference will now be made to the accompanying drawings of which:

Figure 3:
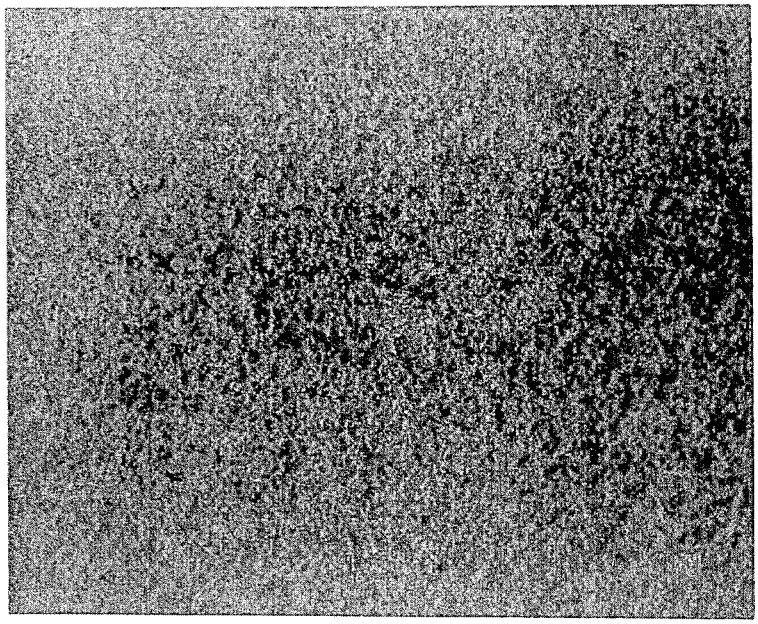
Figure 4:
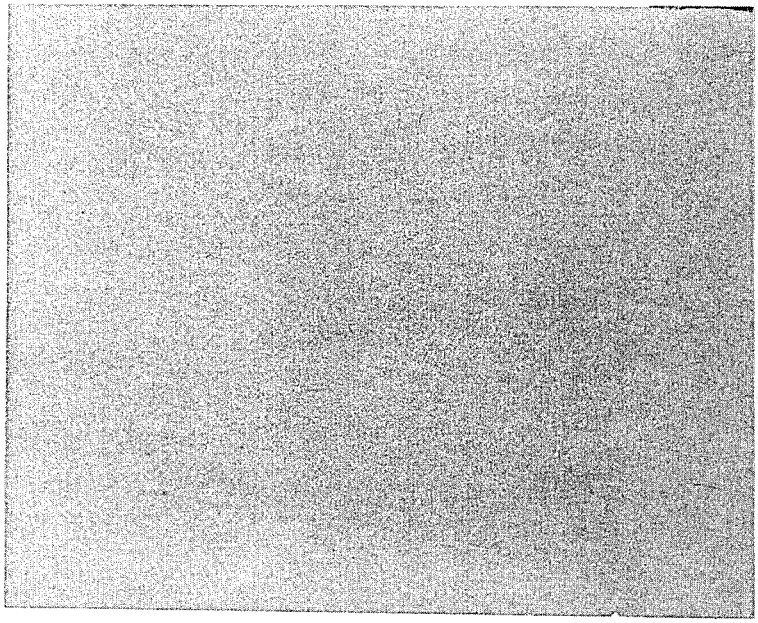
Figure 5:
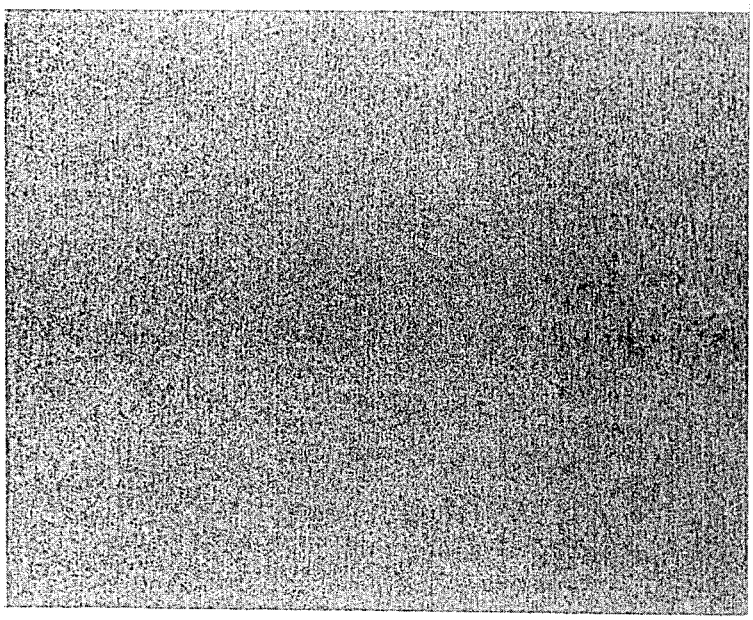
Figure 6:
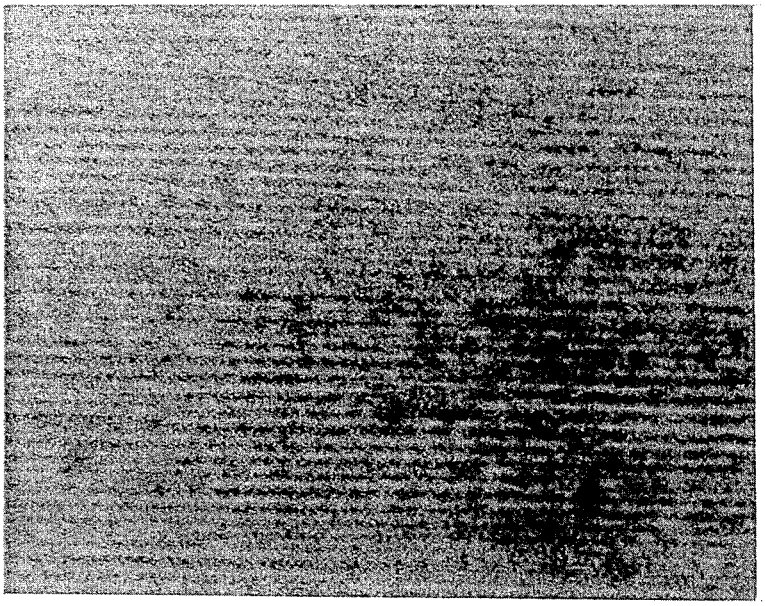

FIGS. 4 and 5 are photographs, at actual size, of portions of sheets of solventless silicone coated paper which have been stained with malachite green dye (applied in aqueous solution) to highlight uncoated areas, the sheets shown in FIGS. 4 and 5 having been coated by the methods used for FIGS. 2 and 3 respectively above; and FIG. 6 is a photograph of a colour developed sheet produced as described with reference to FIG. 2 except that the ratio of applicator roll surface speed to web speed was different.

Figure 1:
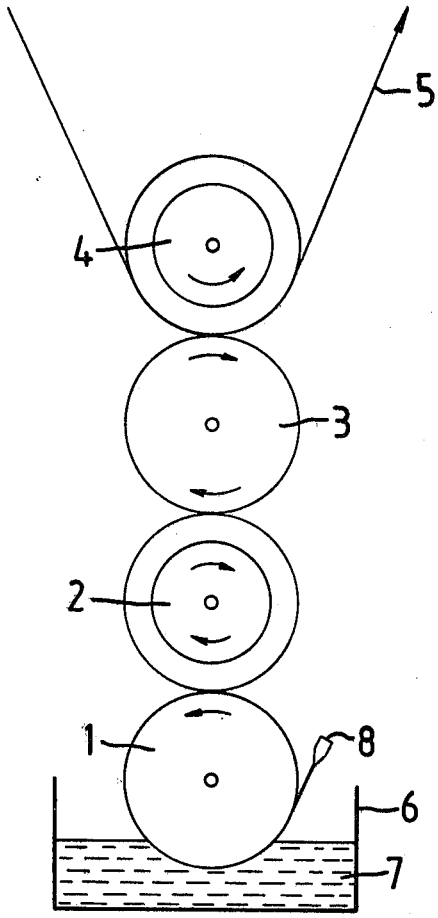
FIG. 1 is a schematic end view of a coating head forming part of a preferred embodiment of the apparatus according to the invention.

Referring first to FIG. 1, the coating head comprises a gravure roll 1, a rubber-covered transfer roll 2 in contact with the gravure roll, an applicator roll 3 in contact with the transfer roll and a rubber-covered backing roll 4 arranged to form a nip with the applicator roll. As indicated by the arrows shown on the rolls, the applicator and transfer rolls are arranged to rotate in the same sense and the gravure and backing rolls are arranged to rotate in the opposite sense.

Independent drive means (not shown) are provided for rotating the applicator roll and the backing roll. The transfer roll 2 drives the gravure roll 1. The gravure roll 1 dips into a bath 6 of coating composition 7. A doctor blade 8 is arranged in contact with the gravure roll 1. An unwind station (not shown) at one side of the coating head and a reel-up station (also not shown) at the other side of the coating head provide means for feeding a web 5 of paper through the nip between the applicator and backing rolls.

When the apparatus is in operation, the gravure roll 1 rotates in the direction shown by the arrow thereon and picks up coating composition 7 from the bath 6. Excess coating composition is removed by the doctor blade 8. The gravure roll applies the coating composition of the transfer roll 2. The transfer roll transfers the coating composition to the applicator roll 3.

The applicator roll 3 transfers the coating composition to the web 5 at the nip between the applicator roll and the backing roll 4. The backing roll serves to hold the paper web in continuous contact with the applicator roll. It will be appreciated that this coating apparatus is a form of forward roll coater.

Figure 2:
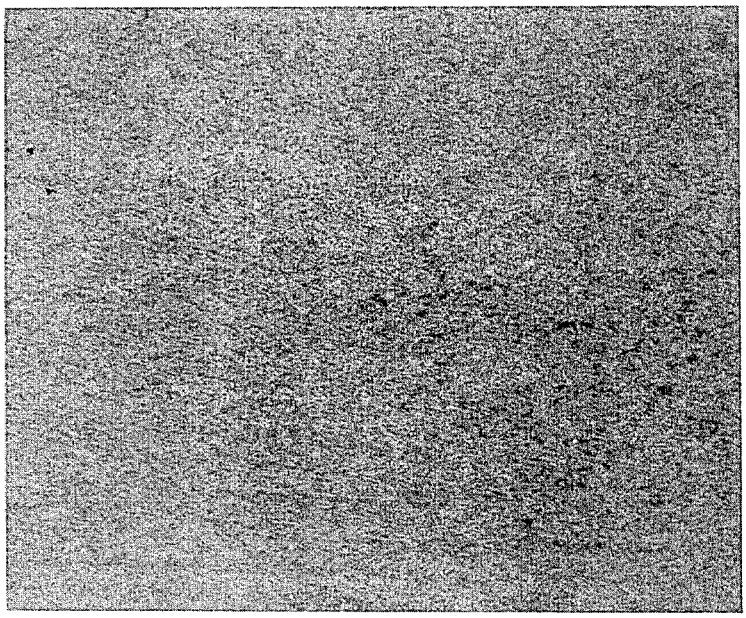
FIGS. 2 and 3 are photographs, at actual size, of portions of a carbonless copying system of which the colour has been developed over the whole area of the portions, the sheets having been coated by a method according to the present invention and the method according to British Pat. No. 1,404,616 respectively.

Referring now to FIGS. 2 and 3 the colour of the sheets shown had been developed by superimposing respective sheets of paper coated with microcapsules containing a colour forming solution on the colour developer sheets and rupturing the microcapsules by means of a calender. In each case the microcapsule coatweight (on a dry basis) was 1 $gm^{-2}$, the coated paper was of substance 49 $gm^{-2}$, the paper speed was 600 $m.min^{-1}$, and the applicator roll surface speed was 400 $m.min^{-1}$. i.e. the ratio of the speed of the applicator roll surface to that of the web was less than 1:1. It will be seen that the pattern shown in FIG. 2 is less blotchy than that of FIG. 3 and this indicates that a superior coating pattern was obtained using apparatus according to the invention.

Referring now to FIGS. 4 and 5, in each case the solventless silicone coatweight was 0.7 $gm^{-2}$, the coated paper was a 135 $gm^{-2}$ release base carrying a 15 $gm^{-2}$, coating of clay, the paper speed was 100 $m.min^{-1}$, and the applicator roll surface speed was 50 $m.min^{-1}$. i.e. the ratio of the speed of the applicator roll surface to that of the web was less than 1:1. It will be seen that the coating of FIG. 4 is substantially more uniform than that of FIG. 5. It will also be seen that the difference between the coatings of FIGS. 4 and 5 is greater than the difference between the coatings of FIGS. 2 and 3. As previously mentioned solventless silicones are coated at very low coatweights and these Figures illustrate that whilst the invention may be used to apply many different types and coatweights of coating, particularly good results are produced at low coatweights.

Referring now to FIG. 6, there is shown a sheet which has been coated at a paper speed of 600 $m.min^{-1}$, and an applicator roll surface speed of 750 $m.min^{-1}$, i.e. the ratio of the speed of the applicator roll surface to that of the web was greater than 1:1. It will be seen that a less even coating pattern is achieved than was the case with the paper shown in FIG. 2.

I claim:

1. A method of applying a coating composition to a continuous web of sheet material, comprising the steps of applying a metered amount of coating composition by means of a gravure roll to a transfer roll, transferring the coating composition from the transfer roll to an applicator roll which is driven independently of, and rotates in the same sense as, the transfer roll, and transferring the composition from the applicator roll to a moving web of sheet material to be coated, characterised in that the direction of movement of the web at its point of contact with the applicator roll is the same as the direction of movement of the applicator roll surface at that point.

2. A method as claimed in claim 1 characterised in that the ratio of the speed of the applicator roll surface to that of the web at their point of contact is not greater than 1:1.

3. An apparatus for applying a coating composition to a continuous web of sheet material comprising a gravure roll arranged to apply a metered amount of coating to a transfer roll, an applicator roll which is arranged to receive coating composition from the transfer roll and is mounted for rotation independently of, and in the same sense as, the transfer roll, and means for feeding the web past the applicator roll characterised in that said means for feeding the web are adapted such that in use the web moves in the same direction as the applicator roll surface which it contacts.

* * * * *